US008120556B2

(12) United States Patent
Kim

(10) Patent No.: US 8,120,556 B2
(45) Date of Patent: Feb. 21, 2012

(54) ORGANIC LIGHT EMITTING DISPLAY HAVING LONGER LIFE SPAN

(75) Inventor: Yangwan Kim, Yongin-si (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 822 days.

(21) Appl. No.: 12/071,852

(22) Filed: Feb. 27, 2008

(65) Prior Publication Data

US 2008/0211796 A1 Sep. 4, 2008

(30) Foreign Application Priority Data

Mar. 2, 2007 (KR) ..... 10-2007-0020802

(51) Int. Cl.
*G09G 3/32* (2006.01)

(52) U.S. Cl. ..... 345/82

(58) Field of Classification Search ..... 345/36, 345/39, 44–46, 74.1–83; 315/169.3; 313/463
See application file for complete search history.

(56) References Cited

U.S. PATENT DOCUMENTS

| | | | | |
|---|---|---|---|---|
| 6,356,029 | B1 | 3/2002 | Hunter | |
| 2005/0168490 | A1* | 8/2005 | Takahara | 345/690 |
| 2005/0269958 | A1 | 12/2005 | Choi et al. | |
| 2006/0055336 | A1 | 3/2006 | Jeong | |
| 2006/0125737 | A1 | 6/2006 | Kwak et al. | |
| 2006/0221028 | A1 | 10/2006 | Aoki | |
| 2006/0253755 | A1 | 11/2006 | Wu | |
| 2006/0256058 | A1 | 11/2006 | Asano et al. | |
| 2007/0040769 | A1 | 2/2007 | Tai et al. | |
| 2007/0046593 | A1* | 3/2007 | Shin | 345/81 |
| 2008/0111804 | A1 | 5/2008 | Choi et al. | |
| 2008/0211747 | A1 | 9/2008 | Kim | |

FOREIGN PATENT DOCUMENTS

| | | | |
|---|---|---|---|
| EP | 1 758 084 | A | 2/2007 |
| JP | 2004-246204 | | 9/2004 |
| JP | 2006-038965 | | 2/2006 |
| JP | 2008-122906 | | 5/2008 |
| JP | 2008-191450 | | 8/2008 |
| JP | 2008-216962 | | 9/2008 |
| KR | 10-2003-0081919 | A | 10/2003 |
| KR | 10-2005-0098485 | A | 10/2005 |
| KR | 10-2006-0000315 | A | 1/2006 |
| KR | 10-2006-0105657 | A | 10/2006 |
| KR | 10-2006-0114537 | A | 11/2006 |

OTHER PUBLICATIONS

European Office Action in EPP99379, dated Sep. 7, 2009 (Kim), European Office Action from prosecution of corresponding European application.

* cited by examiner

*Primary Examiner* — Chanh Nguyen
*Assistant Examiner* — Ram Mistry
(74) *Attorney, Agent, or Firm* — Lee & Morse, P.C.

(57) ABSTRACT

An organic light emitting display, including a driving transistor electrically coupled to a first power line, a first switch electrically coupled to the driving transistor and an emission line, a second switch electrically coupled to the driving transistor and a previous scan line, a third switch electrically coupled to the first switch and a data line, a fourth switch electrically coupled to the data line and the third switch, a fifth switch electrically coupled to the driving transistor and a scan line, a first capacitor electrically coupled to the second switch and the third switch, a second capacitor electrically coupled to the third switch and the fifth switch, and an organic light emitting diode electrically coupled to the driving transistor and a second power line.

19 Claims, 5 Drawing Sheets

ORGANIC LIGHT EMITTING DISPLAY HAVING LONGER LIFE SPAN

BACKGROUND OF THE INVENTION

1. Field of the Invention

Embodiments of the invention relate to an organic light emitting display. More particularly, embodiments relate to an organic light emitting display that may suppress image sticking due to a decrease in efficiency of an organic light emitting diode and may compensate for a threshold voltage of a drive transistor.

2. Description of the Related Art

In general, an organic light emitting display is a display that emits light by electrically exciting a fluorescent or phosphorescent compound. The organic light emitting display may display an image by driving N×M organic light emitting diodes (OLEDs). Each OLED may include an anode electrode (indium tin oxide (ITO)), an organic thin-film layer, and a cathode electrode (metal). To improve light emission efficiency and a balance between electrons and holes, the organic thin-film layer may have a multi-layer structure including an emitting layer (EML), an electron transport layer (ETL) and a hole transport layer (HTL). The organic thin-film may include a separate electron injecting layer (EIL) and a hole injecting layer (HIL).

In general, the anode electrode is coupled to a first power supply to supply holes to the EML, and the cathode electrode is coupled with a second power supply to supply electrons to the EML. The second power supply has a lower voltage than the first power supply. Thus, relative to cathode electrode, the anode electrode has a positive (+) electric potential and, relative to the anode electrode, the cathode has a (−) electrode potential.

The HTL accelerates hole(s) supplied from the anode electrode and supplies the hole(s) to the EML. The ETL accelerates electron(s) supplied from the cathode electrode and supplies the electron(s) to the EML. As a result, at the EML, the electron(s) supplied from the ETL and the hole(s) supplied from the HTL may recombine with each other, thereby generating a predetermined amount of light. The EML layer may include organic material that may generate one of red light (R), green light (G) and blue light (B) when the electron(s) and hole(s) recombine therein.

In such OLEDs, because a voltage applied to the anode electrode is always higher than a voltage applied to the cathode electrode, negative (−) carriers are positioned on the anode electrode, and positive (+) carriers are positioned on the cathode electrode. If the negative (−) carriers positioned on the anode electrode and the positive (+) carriers positioned on the cathode electrode are maintained for a long time, movement of electron(s) and hole(s) may decrease. Thus, efficiency of the OLED(s) may decrease the more the OLED(s) is used. As a result, image sticking may occur and a life span of the OLED(s) may be shortened.

SUMMARY OF THE INVENTION

Embodiments of the invention are therefore directed to organic light emitting display(s) that substantially overcomes one or more of the problems due to the limitations and disadvantages of the related art.

It is therefore a feature of an embodiment of the invention to provide an organic light emitting display that may substantially and/or completely suppress an image sticking phenomenon and a reduction in a life time of the display as a result of degradation of organic light emitting diode(s) therein.

It is therefore a separate feature of an embodiment of the invention to provide an organic light emitting display that may compensate for a threshold voltage of a driving transistor of pixel circuit(s) thereof.

At least one of the above and other features and advantages of the invention may be realized by providing an organic light emitting display, including a driving transistor electrically coupled to a first power line, a first switch electrically coupled to the driving transistor and an emission line, a second switch electrically coupled to the driving transistor and a previous scan line, a third switch electrically coupled to the first switch and a data line, a fourth switch electrically coupled to the data line and the third switch, a fifth switch electrically coupled to the driving transistor and a scan line, a first capacitor electrically coupled to the second switch and the third switch, a second capacitor electrically coupled to the third switch and the fifth switch, and an organic light emitting diode electrically coupled to the driving transistor and a second power line.

The driving transistor may include a control electrode electrically coupled to the second switch, a first electrode electrically coupled to the first switch and the third switch, and a second electrode electrically coupled to the fifth switch and the organic light emitting diode. The first switch may include a control electrode electrically coupled to the emission line, a first electrode electrically coupled to the first power line, and a second electrode electrically coupled to the driving transistor. The second switch includes a control electrode electrically coupled to the previous scan line, a first electrode electrically coupled to a third power line, and a second electrode electrically coupled to the driving transistor.

A voltage of the first power line is higher than a voltage of the third power line. The fourth switch may include a control electrode electrically coupled to the scan line, a first electrode electrically coupled to the data line, and a second electrode electrically coupled to the first capacitor, the second capacitor, and the third switch.

The fifth switch may include a control electrode electrically coupled to the scan line, a first electrode electrically coupled to a node between the driving transistor and the organic light emitting diode. The sixth switch may be further electrically coupled to the fifth switch.

The sixth switch may include a control electrode electrically coupled to the scan line, a first electrode electrically coupled to a third power line, and a second electrode electrically coupled to the fifth switch. The first switch, the second switch, the third switch, the fourth switch and the fifth switch may be P-channel field effect thin-film transistors and the sixth switch is a N-channel field effect thin-film transistor.

The first capacitor may include a first electrode electrically coupled to the second capacitor, the third switch, and the fourth switch, and a second electrode electrically coupled to the driving transistor and the second switch. The second capacitor may include a first electrode electrically coupled to the first capacitor, the third switch, and the fourth switch, and a second electrode electrically coupled to the fifth switch.

The organic light emitting diode may include an anode electrode electrically coupled to the driving transistor and the fifth switch, and a cathode electrode electrically coupled to the second power line.

A third capacitor may be further electrically coupled to a node between the first power line and the first capacitor. The third capacitor may include a first electrode electrically coupled to the first power line and a second electrode electrically coupled to a node between the first capacitor, the second capacitor, the third switch, and the fourth switch.

A voltage of the first power line may be higher than a voltage of the second power line. The third switch may include a control electrode electrically coupled to the previous scan line, a first electrode electrically coupled to a data line, the first capacitor, and the second capacitor, and a second electrode electrically coupled to a node between the first switch and the driving transistor. The fifth switch may be electrically coupled to the sixth switch, and the second switch and the sixth switch are electrically coupled to the third power line.

When the previous scan line has a low level, the scan line has a high level, the emission line has a low level, a first electrode of the first capacitor, a first electrode of the second capacitor and a control electrode of the driving transistor are electrically coupled to a third power line, such that the first electrode of the first capacitor, the first electrode of the second capacitor and the control electrode of the driving transistor are initialized to a voltage level of the third power line.

When the previous scan line is maintained at a low level, the scan line is maintained at a high level, and the emission line changes to a high level, a threshold voltage of the driving transistor may be reflected in the first and second capacitor, such that a voltage of the control electrode of the driving transistor has the voltage the level of the third power line, and the threshold voltage of the driving transistor is compensated.

When the previous scan line changes to a high level, the scan line changes to a low level, and the emission line changes to a low level, a data voltage of the data line may be stored in the first and second capacitors and simultaneously, a threshold voltage of the organic light emitting diode is reflected.

When the previous scan line is maintained at a high level, the scan line changes to a high level and the emission line is maintained at a low level, current provided to the organic light emitting diode through the driving transistor may increase due to the data voltage and the threshold voltage of the organic light emitting diode reflected in the first and second capacitor.

The current provided to the organic light emitting diode may increase in proportion to the threshold voltage of the organic light emitting diode.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
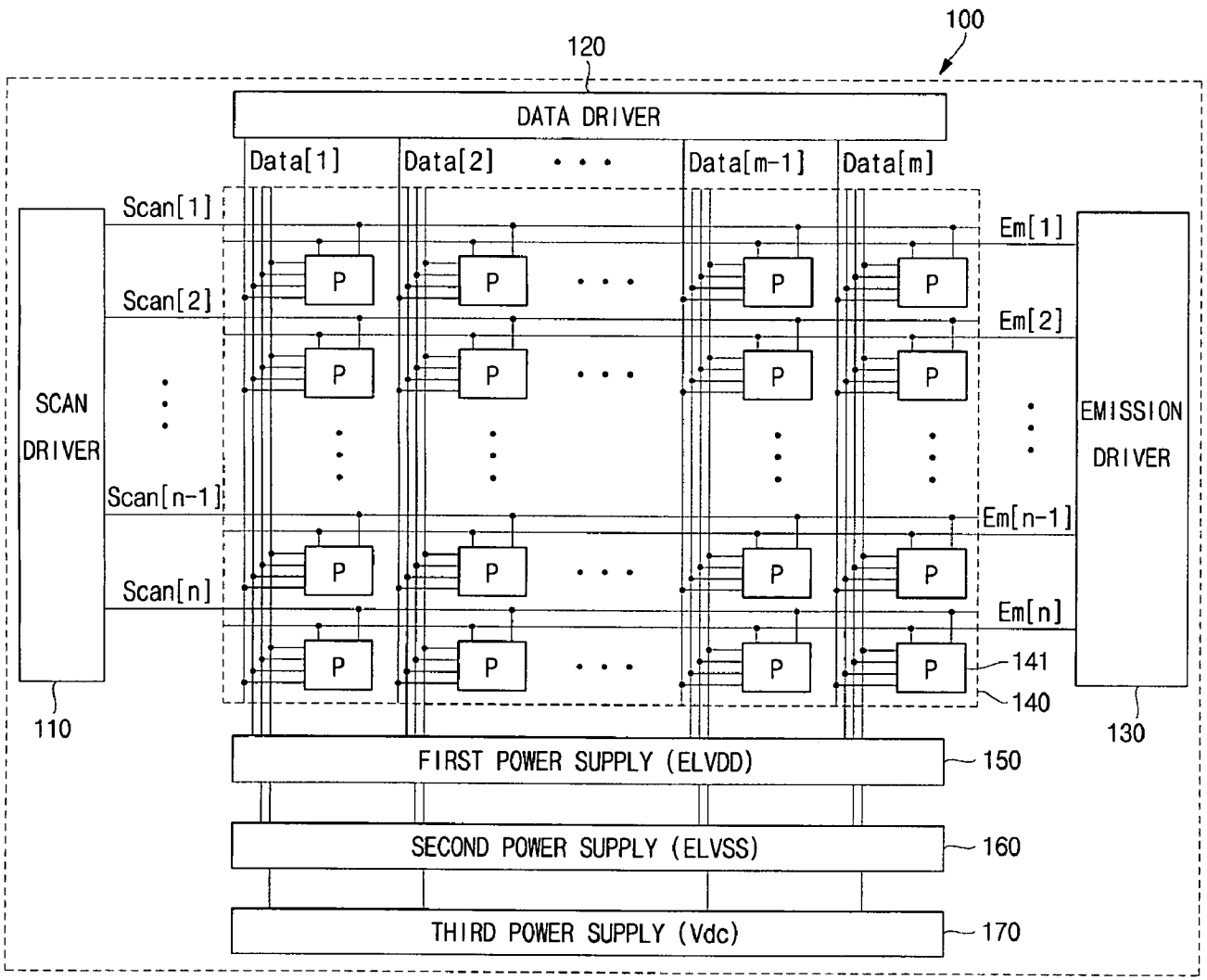
FIG. 1 illustrates a block diagram of an exemplary organic light emitting display according to an exemplary embodiment of the invention.

Korean Patent Application No. 10-2007-0020802, filed on Mar. 2, 2007, in the Korean Intellectual Property Office, and entitled: "Organic Light Emitting Display," is incorporated by reference herein in its entirety.

Embodiments of the invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

Elements having similar constitutions and/or operations are denoted by the same and/or like reference numerals throughout the specification. Furthermore, it should be understood that electrical coupling between a certain component and another component includes direct electrical coupling between them as well as indirect electrical coupling between them by an interposed component. It will also be understood that, unless specified otherwise, when an element is referred to as being "between" two elements, it can be the only element between the two elements, or one or more intervening elements may also be present.

FIG. 1 illustrates a block diagram of an organic light emitting display 100, as an exemplary flat panel display, according to an exemplary embodiment of the invention.

Referring to FIG. 1, the organic light emitting display 100 may include a scan driver 110, a data driver 120, an emission driver 130, an organic light emitting display panel 140 (hereinafter, a panel), a first power supply 150, a second power supply 160 and a third power supply 170.

The scan driver 110 may sequentially apply a scan signal(s) to the panel 140 via a plurality of scan lines (Scan[1], Scan[2], . . . , Scan[n]).

The data driver 120 may apply a data signal(s) to the panel 140 via a plurality of data lines (Data[1], Data[2], . . . , Data[m]).

The emission driver 130 may sequentially apply an emission signal(s) in sequence to the panel 140 via a plurality of emission lines (Em[1], Em[2], . . . , Em[n]).

The panel 140 may include a plurality of scan lines (Scan [1], Scan[2], . . . , Scan[n]) arranged in a column direction, a plurality of emission lines (Em[1], Em[2], . . . , Em[n]) arranged in a column direction, a plurality of data lines (Data [1], Data[2], . . . , Data[m]) arranged in a row direction, and a plurality of pixel circuits 141.

The pixel circuits 141 may be at least partially defined by respective portions of the plurality of scan lines (Scan[1], Scan[2], . . . , and Scan [n]), the plurality of data lines (Data [1], Data[2], . . . , and Data[m]) and the plurality of emission lines (Em[1], Em[2], . . . , and Em[n]). More particularly, each of the pixel circuits 141 may be formed in a region defined by respective portions of two neighboring ones of the plurality of scan lines (Scan[1], Scan[2], . . . , and Scan [n]) (or two neighboring ones of the plurality of emission lines (Em[1], Em[2], . . . , and Em[n])) and two neighboring ones of the plurality of data lines (Data[1], Data[2], . . . , and Data[m]).

The pixel circuits 141 may be driven by respective ones of the plurality of scan lines (Scan[1], Scan[2], . . . , Scan[n]), the plurality of data lines (Data[1], Data[2], . . . , Data[m]), and the plurality of emission lines (Em[1], Em[2], . . . , Em[n]). As described above, a scan signal(s) output from the scan driver 110 may be applied to the respective one of the scan lines (Scan[1], Scan[2], . . . , Scan[n]), a data signal(s) output from the data driver 120 may be applied to the respective one of the data lines (Data[1], Data[2], . . . , Data[m]), and an emission signal(s) output from the emission driver 130 may be applied to the respective one of the emission lines (Em[1], Em[2], . . . , Em[n]).

The first power supply 150, the second power supply 160, and the third power supply 170 may respectively provide a first voltage ELVDD, a second voltage ELVSS, and a third voltage $V_{dc}$ to each of the pixel circuits 141 of the panel 140.

Figure 2:
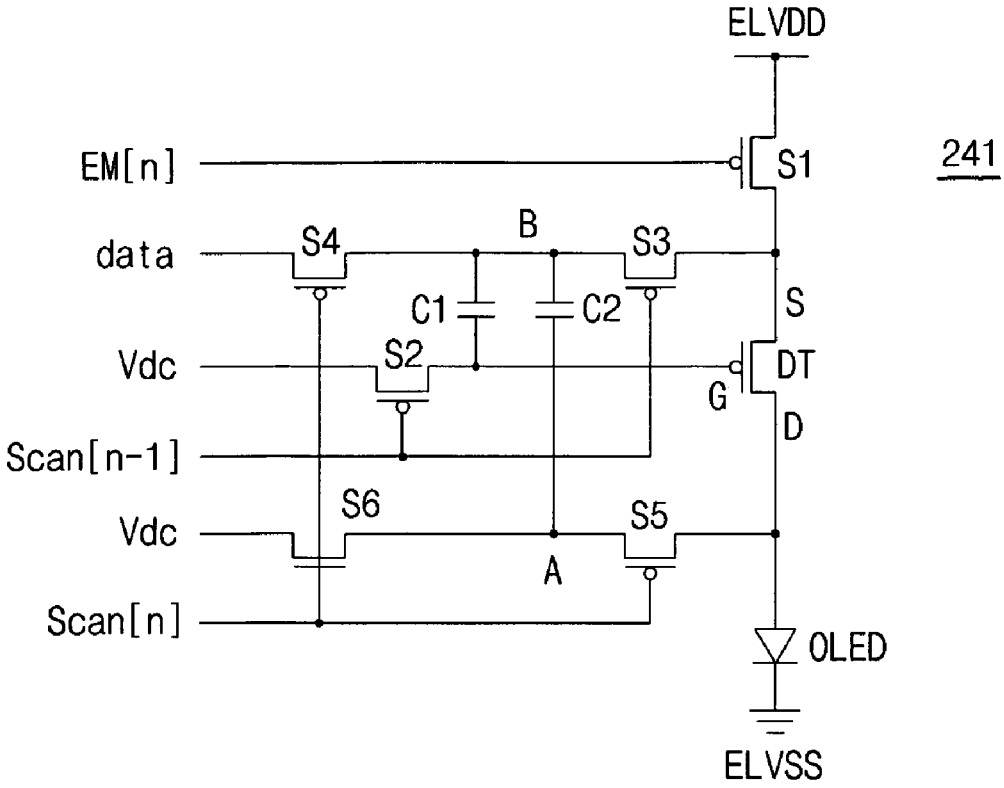
FIG. 2 illustrates a circuit diagram of an exemplary pixel circuit employable by an organic light emitting display according to an exemplary embodiment of the present invention.

FIG. 2 illustrates a circuit diagram of an exemplary pixel circuit 241 employable by an organic light emitting display according to an exemplary embodiment of the present invention. For example, one, some or all of the pixel circuits 141 of the organic light emitting display of FIG. 1 may correspond to the pixel circuit 241 illustrated in FIG. 2. For ease of description, the pixel circuit 241 is illustrated as being coupled to the nth scan line (Scan[n]), the mth data line (Data[m]) and the nth emission line (Em[n]) of the organic light emitting display 100 of FIG. 1.

More particularly, referring to FIG. 2, the pixel circuit 241 may be coupled to the nth emission line (EM[n]), a previous scan line (Scan[n−1]), the nth scan line (Scan[n]), the mth data line (Data[m]), the first power supply (ELVDD), the second power supply (ELVSS) and the third power supply ($V_{dc}$) of the display 100. The pixel circuit 241 may include a first switch S1, a second switch S2, a third switch S3, a fourth switch S4, a fifth switch S5, a sixth switch S6, a first capacitor C1, a second capacitor C2, a driving transistor DT, and an organic light emitting diode (OLED).

As described in more detail below, the emission signal(s) supplied via the nth emission line (EM[n]) may initialize the first and second capacitors C1, C2 and/or substantially and/or completely compensate for a threshold voltage of the driving transistor DT of the pixel circuit 241. Additionally, referring to FIG. 2, in some embodiments with the emission line (EM[n]) electrically coupled to a control electrode of the first switch S1, the emission signal(s) supplied via the emission line (EM[n]) may also control an emission time of the OLED. As one example, if the emission line (EM[n]) is at a low level, the previous scan line (Scan[n−1]) is at a low level, and the scan line (Scan[n]) is at a high level, the first and second capacitor C1, C2 may be initialized to a value between the level of the first power supply (ELVDD) and the level of the third power supply ($V_{dc}$). As described above, the emission line (EM[n]) may be electrically coupled to the emission driver 130 (see FIG. 1) for generating an emission signal(s) supplied thereto.

The previous scan line (Scan[n−1]) may apply a previous scan signal, for selecting the previous scan line (Scan[n−1]) to the pixel 241 of the nth scan line (Scan[n]) during a previous (n−1)th scanning period. Referring to FIG. 2, the previous scan line (Scan[n−1]) may apply the previous scan signal to a control electrode of the second switch S2 and a control electrode of the third switch S3 during the previous (n−1)th scanning period. If the previous scan signal supplied to the previous scan line (Scan[n−1]) is at a low level while the emission line (EM[n]) is at a high level, and the scan line (Scan[n]) is at a high level, a threshold voltage of the driving transistor DT may be stored in the first and second capacitors C1, C2.

The nth scan line (Scan[n]) may apply a respective scan signal(s) from the scan driver 110 (see FIG. 1) to select respective ones of the pixel circuits coupled to the nth scan line (Scan[n]) which are to emit light during an nth driving period. That is, during the nth driving period, OLEDs of the selected ones of the pixels circuits coupled to the nth scan line (Scan[n]) may emit light. More particularly, e.g., the pixel circuit 241 may be selected to emit light during a driving period by supplying the scan signal thereto. Referring to FIG. 2, the nth scan line (Scan[n]) may apply a respective scan signal(s) to a control electrode of the fourth switch S4, a control electrode of the fifth switch S5, and a control electrode of the sixth switch S6. For example, in embodiments in which the fourth switch S4 and the fifth switch S5 are p-type transistors, the nth scan signal may be described as 'supplied' when the scan signal has a low voltage level. When the nth scan signal is supplied to the pixel circuit 241, the OLED thereof may emit light during the respective driving period. More particularly, when the nth scan signal is supplied to the nth scan line (Scan[n]), a data voltage from the mth data line (Data[m]) may be stored in the first and second capacitors C1,C2, and simultaneously, a voltage ($V_{EL}$) of the OLED may be sensed and reflected. The nth scan line (Scan[n]) is electrically coupled to the scan driver 110, which may produce the respective scan signal(s).

The mth data line (Data[m]) may apply a data signal (voltage), from the data driver 120 (see FIG. 1) to the first and second capacitors C1, C2 and the driving transistor DT. The voltage of the data signal may be proportional or inversely proportional to a light emission brightness of the OLED of the pixel circuit 241. The mth data line (Data[m]) may be electrically coupled to the data driver 120 (see FIG. 1), which may produce the respective data signal(s).

A first power line may enable the first voltage (ELVDD) to be applied to the OLED of the pixel circuit 241. The first power line may be coupled to the first power supply 150 (see FIG. 1), which may supply the first voltage (ELVDD).

A second power line may enable the second voltage (ELVSS) to be applied to the OLED of the pixel circuit 241. The second power line may be coupled to the second power supply 160 (see FIG. 1), which may supply the second voltage (ELVSS). The first voltage (ELVDD) may be higher than the second voltage (ELVSS).

A third power line may enable the third voltage ($V_{dc}$) to be applied to the first and second capacitors C1, C2 and a control electrode of the driving transistor DT. The third power line may be coupled to the third power supply 170 (see FIG. 1), which may supply the third voltage. The third voltage ($V_{dc}$) may be lower than the first voltage (ELVDD).

Referring to FIG. 2, the first switch S1 may include a control electrode (gate electrode) electrically coupled to the nth emission line (EM[n]), a first electrode (source electrode or drain electrode) electrically coupled to the first power line for receiving the first voltage (ELVDD), and a second electrode (the other of drain electrode or source electrode) electrically coupled to the driving transistor DT.

The second switch S2 may include a control electrode electrically coupled to the previous scan line (Scan[n−1]), a first electrode electrically coupled to the third power line for receiving the third voltage ($V_{dc}$), and a second electrode electrically coupled to the driving transistor DT.

The third switch S3 may include a control electrode electrically coupled to the previous scan line (Scan[n−1]), a first electrode electrically coupled to the fourth switch S4, the first capacitor C1, and the second capacitor C2, and a second electrode electrically coupled to a node between the first switch S1 and the driving transistor DT.

The fourth switch S4 may include a control electrode electrically coupled to the nth scan line (Scan[n]), a first electrode electrically coupled to the data line (Data[m]), and a second electrode electrically coupled to the first capacitor C1, the second capacitor C2, and the third switch S3.

The fifth switch S5 may include a control electrode electrically coupled to the nth scan line (Scan[n]), a first electrode electrically coupled to a node between the driving transistor DT and the OLED, and a second electrode electrically coupled to the sixth switch S6.

The sixth switch S6 may include a control electrode electrically coupled to the scan line (Scan[n]), a first electrode electrically coupled to the third power line for supplying the third voltage ($V_{dc}$), and a second electrode electrically coupled to the fifth switch S5.

As described above, when a scan signal of a low level is applied to the pixel circuit 241 via the nth scan line (Scan[n]), the fourth switch S4 and the fifth switch S5 are turned on, and the sixth switch S6 is turned off. When a scan signal of a high level is applied to the pixel circuit 241 via the scan line (Scan[n]), the fourth switch S4 and the fifth switch S5 are turned off, and the sixth switch S6 is turned on.

The first capacitor C1 may include a first electrode electrically coupled to a node (B) between the second capacitor C2, the third switch S3, and the fourth switch S4, and a second electrode electrically coupled to the driving transistor DT and the second switch S2.

The second capacitor C2 may include a first electrode electrically coupled to the node (B) between the first capacitor C1, the third switch S3, and the fourth switch S4, and a second electrode electrically coupled to a node (A) between the fifth switch S5 and the sixth switch S6.

A first electrode of the driving transistor DT may be electrically coupled to the first switch S1 and the third switch S3 and a second electrode thereof may be electrically coupled to the fifth switch S5 and the OLED. The control electrode of the driving transistor DT may be electrically coupled to the first capacitor C1 and the second switch S2.

In the exemplary embodiment illustrated in FIG. 2, the first, second, third, fourth, and fifth switches S1, S2, S3, S4, S5 and the driving transistor DT are illustrated as p-type transistors, e.g., p-channel field effect transistors, and the sixth switch S6 is illustrated as a n-type transistor, e.g., a n-channel field effect transistor. However, embodiments of the invention are not limited thereto.

The driving transistor DT and/or the first, second, third, fourth and fifth switches S1, S2, S3, S4, S5, S6 may be any one selected from an amorphous silicon thin film transistor, a poly silicon thin film transistor, an organic thin film transistor, a micro thin film transistor, and equivalents thereof. However, embodiments of the invention are not limited thereto.

If the driving transistor DT and/or the switches S1, S2, S3, S4, S5, S6 are poly silicon thin film transistors, they may be formed using, e.g., a laser crystallization method, a metal induction crystallization method, and equivalent methods thereof. However, embodiments of the invention are not limited thereto.

The OLED may include an anode electrode electrically coupled to the driving transistor DT and the fifth switch S5, and a cathode electrode electrically coupled to the second power line for supplying the second voltage (ELVSS). The OLED may emit lights of a predetermined brightness based on an amount of current controllably supplied thereto via the driving transistor DT.

The OLED may include an emitting layer. The emitting layer may include, e.g., a low-polymer or a high-polymer. However, embodiments of the invention are not limited thereto. Because characteristics of a low-polymer material are widely known, it can be easily developed, and mass production is possible at an early stage. A high-polymer material may have excellent thermal stability, superior mechanical hardness, and a more-natural color as compared with a low-polymer material.

Figure 3:
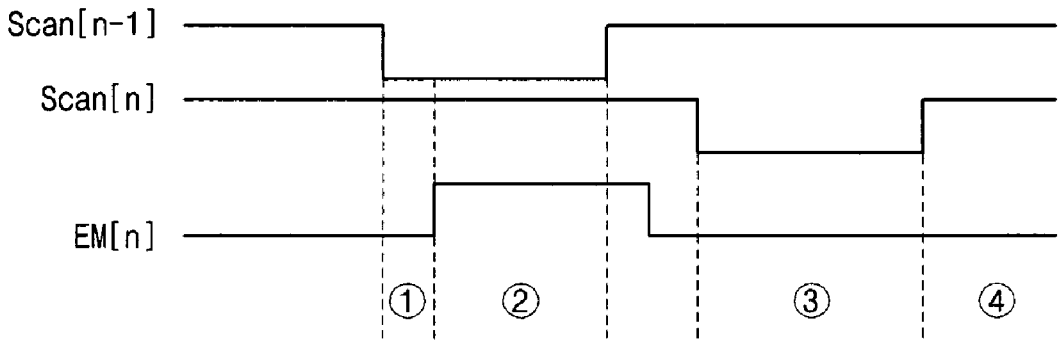
FIG. 3 illustrates a timing diagram of exemplary signals employable to drive the pixel circuit of FIG. 2.

FIG. 3 illustrates a timing diagram of exemplary signals employable to drive the pixel circuit 241 of FIG. 2.

As illustrated in FIG. 3, a driving period for driving the pixel circuit 241 may include an initializing period (①), a threshold voltage compensating period (②), a data writing and OLED voltage sensing period (③), and an emitting period (④).

An exemplary operation of the pixel circuit 241 according to an exemplary embodiment of the invention will be described with reference to FIGS. 2 through 7.

Figure 4:
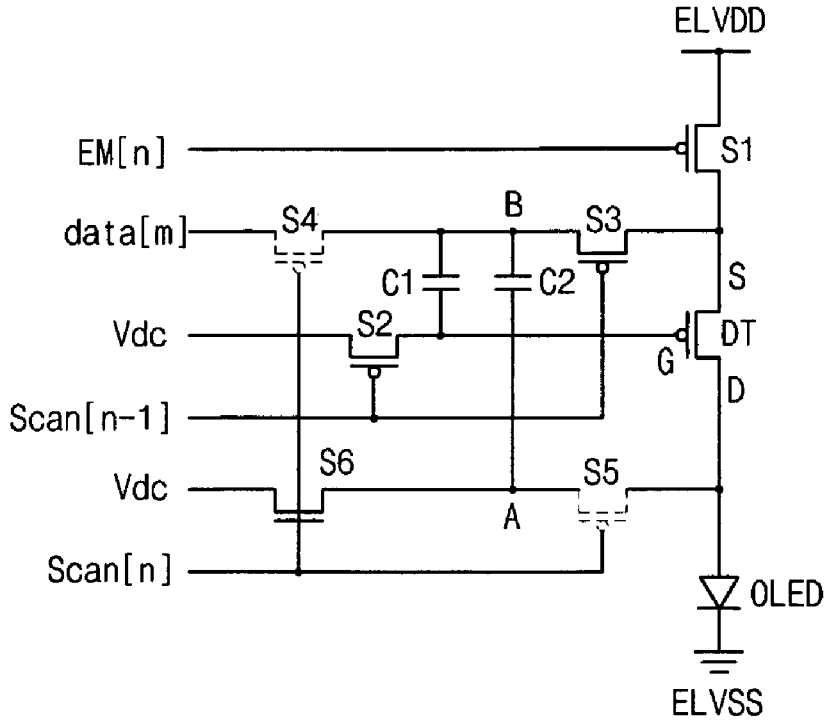
FIG. 4 illustrates an operating state of the pixel circuit of FIG. 2 during an initializing period.

FIG. 4 illustrates an operating state of the pixel circuit 241 of FIG. 2 during an initializing period (①).

During the initializing period (①), an emission signal at a low level may be applied to the control electrode of the first switch S1 via the nth emission line (EM[n]). A previous scan signal at a low level may be applied to the control electrode of the second switch S2 and the control electrode of the third switch S3 via the previous scan line (Scan[n−1]). A scan signal at a high level may be applied to the fourth switch S4, the fifth switch S5, and the sixth switch S6 via the scan line (Scan[n]).

Therefore, during the initializing period (①), the first switch S1, the second switch S2, the third switch S3, and the sixth switch S6 are turned on while the fourth switch S4 and the fifth switch S5 are turned off.

Accordingly, the first electrode of the first capacitor C1 may be electrically coupled to the first power line for supplying the first voltage (ELVDD). The first electrode of the second capacitor C2 may also be electrically coupled to the first power line for supplying the first voltage (ELVDD). The second electrode of the first capacitor C1 and the second electrode of the second capacitor C2 may be electrically coupled to the third power line ($V_{dc}$). The control electrode of the driving transistor DT may also be electrically coupled to the third power line ($V_{dc}$).

During the initializing period (①), a voltage of the control electrode of the driving transistor DT and a voltage of the first electrode of the driving transistor DT may be determined by the following Equation Set 1.

$$V_G=V_A=V_{dc}$$

$$V_S=V_B=\text{ELVDD} \qquad \text{[Equation Set 1]}$$

Here, $V_G$ is a voltage of the control electrode of the driving transistor DT. $V_A$ is a voltage of node (A) between the second capacitor C2, the sixth switch S6 and the fifth switch S5. $V_{dc}$ is the third voltage supplied via the third power line.

Further, $V_S$ is a voltage of the first electrode of the driving transistor DT. $V_B$ is a voltage of node (B) between the third switch S3, the first capacitor C1, the second capacitor C2 and the fourth switch S4. ELVDD is the first voltage supplied via the first power line.

Figure 5:
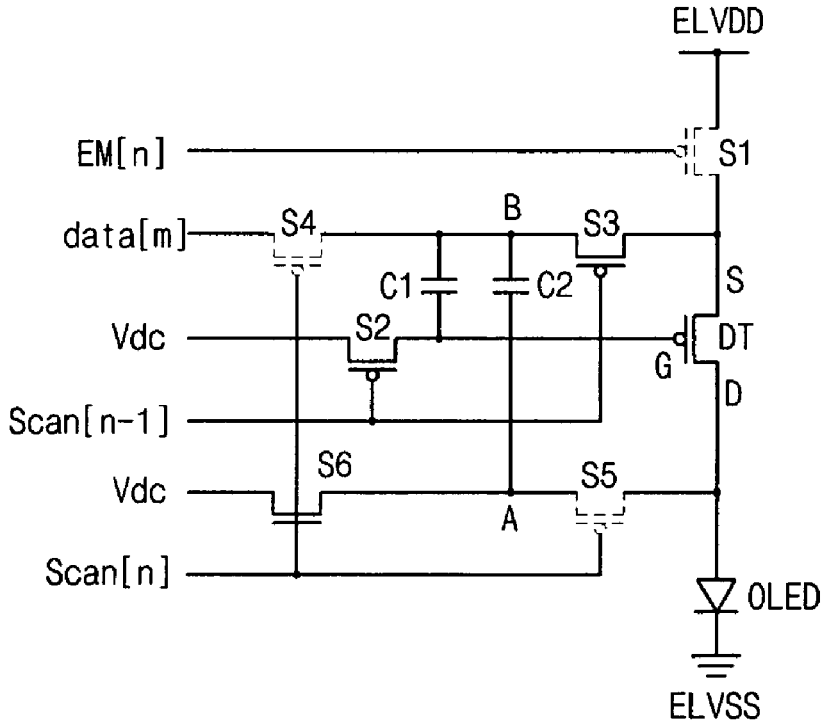
FIG. 5 illustrates an operating state of the pixel circuit of FIG. 2 during a threshold voltage compensating period.

FIG. 5 illustrates an operating state of the pixel circuit 241 of FIG. 2 during a threshold voltage compensating period (②).

An emission signal at a high level may be applied to the control electrode of the first switch S1 via the nth emission line (EM[n]). A previous scan signal at a low level may be applied to the control electrode of the second switch S2 and the control electrode of the third switch S3 via the previous scan line (Scan[n−1]). A scan signal at a high level may be applied to the control electrodes of the fourth switch S4, the fifth switch S5 and the sixth switch S6 via the scan line (Scan[n]).

Therefore, during the threshold voltage compensating period (②), the second switch S2, the third switch S3, and the sixth switch S6 are turned on while the first switch S1, the fourth switch S4, and the fifth switch S5 are turned off.

Accordingly, the first electrode of the first capacitor C1 and the first electrode of the second capacitor C2 are electrically separated from the first power line for supplying the first voltage (ELVDD). The first electrode of the first capacitor C1 and the first electrode of the second capacitor C2 may remain electrically coupled to the first electrode of the driving transistor DT via the third switch S3. The second electrode of the first capacitor C1 and the second electrode of the second capacitor C2 may remain electrically coupled to the third power line ($V_{dc}$) via the second and sixth switches S2, S6, respectively.

Under such conditions, voltages of the first electrode of the first capacitor C1, the first electrode of the second capacitor C2, and the first electrode of the driving transistor DT may fall from the first voltage (ELVDD), but may not fall below the threshold voltage of the driving transistor DT.

That is, during the threshold voltage compensating period (②), a voltage of the control electrode of the driving transistor DT and a voltage of the first electrode of the driving transistor may be determined by the following Equation Set 2.

$$V_G=V_A=V_{dc}$$

$$V_S=V_B=V_{dc}|Vth| \quad \text{[Equation Set 2]}$$

That is, during a threshold voltage compensating period (②), because the node (B) is electrically separated from the first power line for supplying the first voltage (ELVDD), a voltage $V_B$ at the node (B) may continue to fall, but may not fall below a threshold voltage $V_{th}$ of the driving transistor DT. Accordingly, a threshold voltage $V_{th}$ of the driving transistor DT may be stored in the first capacitor C1 and the second capacitor C2.

Figure 6:
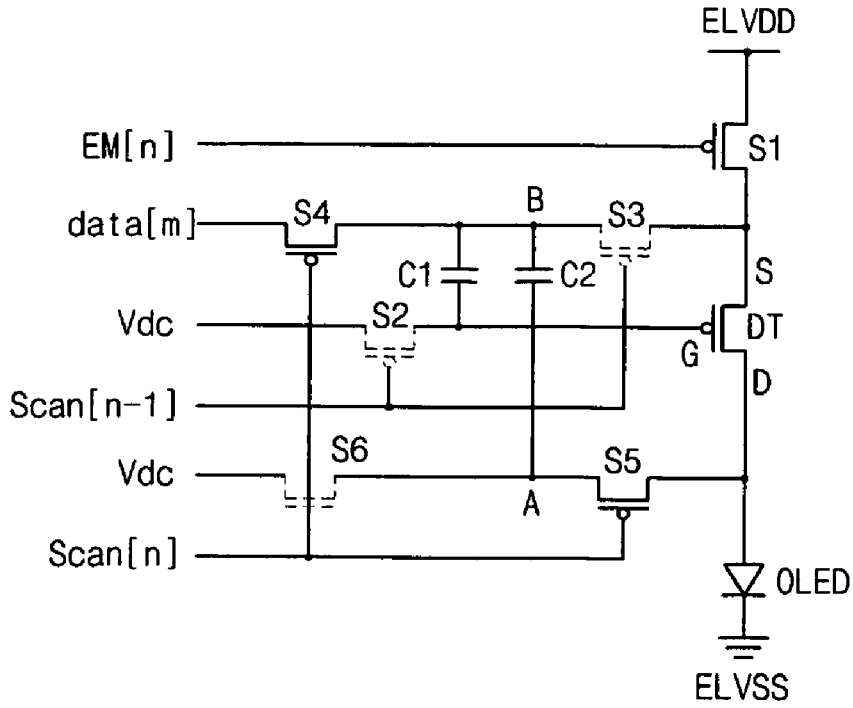
FIG. 6 illustrates an operating state of the pixel circuit of FIG. 2 during a date write period and a voltage sensing period.

FIG. 6 illustrates an operating state of the pixel circuit 241 of FIG. 2 during a data writing and OLED voltage sensing period (③).

During the data writing and OLED voltage sensing period (③), an emission signal at a low level is applied to the control electrode of the first switch S1 via nth the emission line (EM[n]). A previous scan signal at a high level is applied to the control electrode of the second switch S2 and the control electrode of the third switch S3 via the previous scan line (Scan[n−1]). A scan signal at a low level is applied to the fourth switch S4, the fifth switch S5, and the sixth switch S6 via the nth scan line (Scan[n]).

Therefore, during the data writing and OLED voltage sensing period (③), the first switch S1, the fourth switch S4, and the fifth switch S5 are turned on, and the second switch S2, the third switch S3, and the sixth switch S6 are turned off.

Accordingly, during the data writing and OLED voltage sensing period (③), the first electrode of the first capacitor C1 and the first electrode of the second capacitor C2 may be electrically coupled to the mth data line (Data[m]). The second electrode of the first capacitor C1 may be electrically coupled to the control electrode of the driving transistor DT, and the second electrode of the second capacitor C2 may be electrically coupled to a node between the second electrode of the driving transistor DT and the anode electrode of the OLED via the fifth switch S5.

Accordingly, during the data writing and OLED voltage sensing period (③), voltages of the node (A) and the node (B) may change. More particularly, during the data writing and OLED voltage sensing period (③), the voltages of the node (A) and the node (B) may be determined by the following Equation Set 3.

$$V_A=V_{EL}$$

$$V_B=V_{data} \quad \text{[Equation Set 3]}$$

Here, $V_{EL}$ is a voltage that may applied to the anode electrode of the OLED. In some embodiments, $V_{EL}$ increases as a degradation level of the OLED increases.

Further, in some embodiments, a voltage of the control electrode of the driving transistor DT may be determined by the following Equation Set 4.

$$V_C=V_{dc}+\Delta V_G$$

$$\Delta V_G=V_{data}-(V_{dc}+|Vth|)$$

$$V_G=V_{data}-|Vth| \quad \text{[Equation Set 4]}$$

Figure 7:
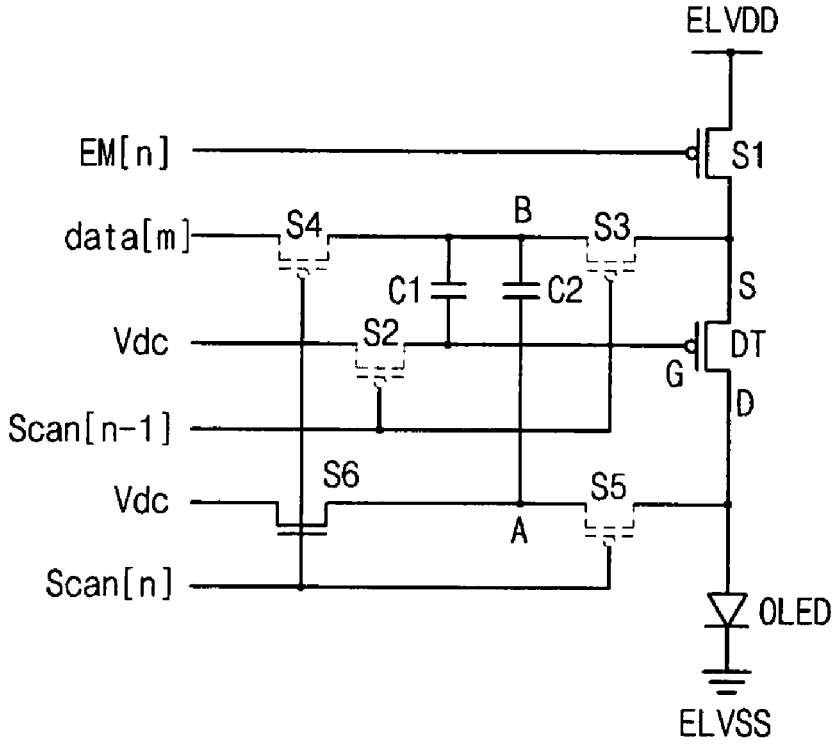
FIG. 7 illustrates an operating state of the pixel circuit of FIG. 2 during an emitting period.

FIG. 7 illustrates an operating state of the pixel circuit 241 of FIG. 2 during an emitting period (④).

During the emitting period (④), an emission signal at a low level may be applied to the control electrode of the first switch S1 via the nth emission line (EM[n]). A previous scan signal at a high level may be applied to the control electrode of the second switch S2 and the control electrode of the third switch S3 via the previous scan line (Scan[n−1]). A scan signal at a high level may be applied to the fourth switch S4, the fifth switch S5, and the sixth switch S6 via the nth scan line (Scan[n]).

Therefore, during the emitting period (④), the first switch S1 and the sixth switch S6 are turned on, and the second switch S2, the third switch S3, the fourth switch S4, and the fifth switch S5 are turned off.

Accordingly, during the emitting period (④), the second electrode of the first capacitor C1 may be electrically coupled to the control electrode of the driving transistor DT, The first electrode of the first capacitor C1 may be electrically coupled to the first electrode of the second capacitor C2. That is, the first capacitor C1 may be coupled to the second capacitor C2 in series. The second electrode of the second capacitor C2 may be electrically coupled to the third power line for supplying the third voltage ($V_{dc}$).

During the emitting period (④), a voltage of node (A) may change and may be determined by the following Equation 5.

$$V_A=V_{dc} \quad \text{[Equation 5]}$$

A voltage of the control electrode of the driving transistor DT may be determined by the following Equation Set 6.

$$V_G=V_{data}-|Vth|+\Delta V_{G2}$$

$$\Delta V_{G2}=V_{dc}-V_{EL}$$

$$V_G=V_{data}-|Vth|+V_{dc}-V_{EL} \quad \text{[Equation Set 6]}$$

During the emitting period (④), a current $I_{OLED}$ that may be supplied to the OLED in accordance with Equation Set 6 may be determined by the following Equation 7.

$$\begin{aligned} I_{OLED} &= \frac{\beta}{2}(V_{GS}-V_{th})^2-\frac{\beta}{2}(V_{SG}-|V_{th}|)^2 \quad \text{[Equation 7]} \\ &= \frac{\beta}{2}(V_S-V_G-|V_{th}|)^2 \\ &= \frac{\beta}{2}(ELVDD-V_{data}+|V_{th}|-V_{dc}+V_{EL}-|V_{th}|)^2- \end{aligned}$$

-continued $$\frac{\beta}{2}(ELVDD - V_{data} - V_{dc} + V_{EL})^2$$

As may be seen in Equation 7, in some embodiments of the invention, the more the voltage $V_{EL}$ of the OLED increases, the more the current $I_{OLED}$ flowing through the OLED may increase. That is, in some embodiments, the current $I_{OLED}$ flowing through the OLED may increase proportionally to the voltage $V_{EL}$ of the OLED. In some embodiments, by increasing the voltage $V_{EL}$ of the OLED as the efficiency of the OLED decreases, it is possible to substantially and/or completely suppress image sticking by increasing an amount of the current $I_{OLED}$ supplied to the OLED. As a result, some embodiments of the invention may enable a lifetime of an organic light emitting display to be increased by controllably increasing the current $I_{OLED}$ supplied to the OLED as efficiency thereof decreases. Further, in some embodiments of the invention, a threshold voltage of the driving transistor DT may be effectively stored effectively and substantially and/or completely compensated.

Figure 8:
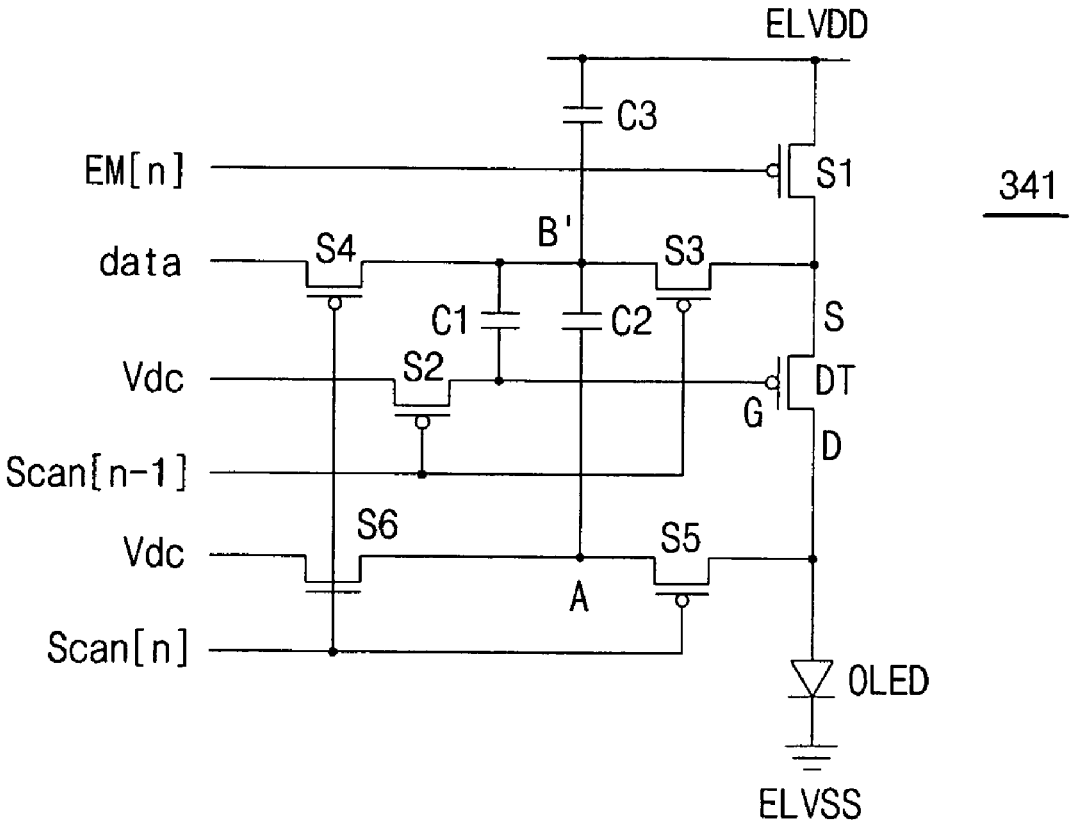
FIG. 8 illustrates a circuit diagram of another exemplary pixel circuit employable by an organic light emitting display according to another embodiment of the invention.

FIG. 8 illustrates a circuit diagram of another exemplary pixel circuit 341 employable by an organic light emitting display according to another embodiment of the invention. For example, one, some, or all of the pixel circuits 141 of the organic light emitting display of FIG. 1 may correspond to the pixel circuit 341 illustrated in FIG. 7. For ease of description, the pixel circuit 341 is illustrated as being coupled to the nth scan line (Scan[n]), the mth data line (Data[m]) and the nth light emission control line (Em[n]) of the organic light emitting display 100 of FIG. 1.

As shown in FIG. 8, the pixel circuit 341 may have the same structure as the exemplary pixel circuit 241 of FIG. 2. In general, only differences between the pixel circuit 341 of FIG. 8 and the pixel circuit 241 of FIG. 2 will be described below. Referring to FIG. 8, in some embodiments, the pixel circuit 341 may include a third capacitor C3 electrically coupled between the first power line for supplying the first voltage (ELVDD) and the second capacitor C2. A first electrode of the third capacitor C3 may be electrically coupled to the first power line for supplying the first voltage (ELVDD). A second electrode of the third capacitor C3 may be electrically coupled to a node (B') between the third switch S3, the fourth switch S4, the first capacitor C1, and the second capacitor C2.

The third capacitor C3 may adjust a value of a voltage change due to a voltage $V_{EL}$ of the OLED and may be employed in a feedback function. That is, in the pixel circuit 241 illustrated in FIG. 2, because the voltage $V_{EL}$ of the OLED may be fed back to the control electrode of the driving transistor DT, the current $I_{OLED}$ of the organic light emitting diode may increase excessively.

However, in the pixel circuit 341 illustrated in FIG. 8, a value of voltage change due to the voltage $V_{EL}$ of the OLED may be controllably adjusted by the third capacitor C3 and feedback may be controllably executed. More particularly, in the pixel circuit 341 illustrated in FIG. 8, the current provided to the OLED is determined by the following Equation 8. As may be seen from Equation 8, in some embodiments, the voltage $V_{EL}$ of the OLED, for which a feedback operation is executed by the third capacitor C3, may be adjusted.

$$I_{OLED} = \frac{\beta}{2}(V_{GS} - V_{th})^2 \quad \text{[Equation 8]}$$

-continued $$= \frac{\beta}{2}(V_{SG} - |V_{th}|)^2$$

$$= \frac{\beta}{2}(V_S - V_U - |V_{th}|)^2$$

$$= \frac{\beta}{2}(ELVDD - (V_{data} - |V_{th}| + (V_{dc} - V_{EL}) \cdot \frac{C_2}{C_2 + C_3}) - |V_{th}|)^2$$

$$= \frac{\beta}{2}\left(ELVDD - V_{data} - (V_{dc} - V_{EL}) \cdot \frac{C_2}{C_2 + C_3}\right)^2$$

$$= \frac{\beta}{2}\left(ELVDD - V_{data} - V_{dc} \cdot \frac{C_2}{C_2 + C_3} + V_{EL} \cdot \frac{C_2}{C_2 + C_3}\right)^2$$

Some embodiments may provide an organic light emitting display in which an increasing threshold voltage of an OLED, which may be proportional to an amount of degradation of the OLED, may be sensed during a data writing period, and thus, an amount of current supplied to the OLED may be increased in proportion to the sensed voltage, such that image sticking and/or a reduction in a lifetime of the display due to degradation of the OLED may be substantially and/or completely suppressed.

Further, in some embodiments of an organic light emitting display according to the invention, a storage capacitor may be electrically coupled to a node between a control electrode of a driving transistor and a first electrode of the driving transistor, and thus, a power source voltage provided to the first electrode thereof may be blocked, and a threshold voltage of the driving transistor may be stored naturally in the storage capacitor. That is, some embodiments of the present invention may compensate for a threshold voltage of the driving transistor without employing a diode-coupled structure.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An organic light emitting display, comprising:

a driving transistor electrically coupled to a first power line;

a first switch electrically coupled to the driving transistor and an emission line;

a second switch electrically coupled to the driving transistor and a previous scan line;

a third switch electrically coupled to the first switch and a data line;

a fourth switch electrically coupled to the data line and the third switch;

a fifth switch electrically coupled to the driving transistor and a scan line;

a sixth switch electrically coupled to the fifth switch;

a first capacitor electrically coupled to the second switch and the third switch;

a second capacitor electrically coupled to the third switch and the fifth switch; and an organic light emitting diode electrically coupled to the driving transistor and a second power line, the organic light emitting diode being directly coupled to the driving transistor, wherein the first switch, the second switch, the third switch, the fourth switch, and the fifth switch are P-channel field effect thin-film transistors, and the sixth switch is a N-channel field effect thin-film transistor, wherein:

the second switch and the sixth switch are electrically coupled to the third power line, and when the previous scan line has a low level, the scan line has a high level, the emission line has a low level, a first electrode of the first capacitor, a first electrode of the second capacitor and a control electrode of the driving transistor are electrically coupled to a third power line, such that the first electrode of the first capacitor, the first electrode of the second capacitor and the control electrode of the driving transistor are initialized to a voltage level of the third power line.

2. The organic light emitting display as claimed in claim 1, wherein the driving transistor includes a control electrode electrically coupled to the second switch, a first electrode electrically coupled to the first switch and the third switch, and a second electrode electrically coupled to the fifth switch and the organic light emitting diode.

3. The organic light emitting display as claimed in claim 1, wherein the first switch includes a control electrode electrically coupled to the emission line, a first electrode electrically coupled to the first power line, and a second electrode electrically coupled to the driving transistor.

4. The organic light emitting display as claimed in claim 1, wherein the second switch includes a control electrode electrically coupled to the previous scan line, a first electrode electrically coupled to a third power line, and a second electrode electrically coupled to the driving transistor.

5. The organic light emitting display as claimed in claim 4, wherein a voltage of the first power line is higher than a voltage of the third power line.

6. The organic light emitting display as claimed in claim 1, wherein the fourth switch includes a control electrode electrically coupled to the scan line, a first electrode electrically coupled to the data line, and a second electrode electrically coupled to the first capacitor, the second capacitor, and the third switch.

7. The organic light emitting display as claimed in claim 1, wherein the fifth switch includes a control electrode electrically coupled to the scan line, a first electrode electrically coupled to a node between the driving transistor and the organic light emitting diode.

8. The organic light emitting display as claimed in claim 1, wherein the sixth switch includes a control electrode electrically coupled to the scan line, a first electrode electrically coupled to a third power line, and a second electrode electrically coupled to the fifth switch.

9. The organic light emitting display as claimed in claim 1, wherein the first capacitor includes a first electrode electrically coupled to the second capacitor, the third switch, and the fourth switch, and a second electrode electrically coupled to the driving transistor and the second switch.

10. The organic light emitting display as claimed in claim 1, wherein the second capacitor includes a first electrode electrically coupled to the first capacitor, the third switch, and the fourth switch, and a second electrode electrically coupled to the fifth switch.

11. The organic light emitting display as claimed in claim 1, wherein the organic light emitting diode includes an anode electrode electrically coupled to the driving transistor and the fifth switch, and a cathode electrode electrically coupled to the second power line.

12. The organic light emitting display as claimed in claim 1, wherein a third capacitor is further electrically coupled to a node between the first power line and the first capacitor.

13. The organic light emitting display as claimed in claim 12, wherein the third capacitor includes a first electrode electrically coupled to the first power line and a second electrode electrically coupled to a node between the first capacitor, the second capacitor, the third switch, and the fourth switch.

14. The organic light emitting display as claimed in claim 1, wherein a voltage of the first power line is higher than a voltage of the second power line.

15. The organic light emitting display as claimed in claim 1, wherein the third switch includes a control electrode electrically coupled to the previous scan line, a first electrode electrically coupled to a data line, the first capacitor, and the second capacitor, and a second electrode electrically coupled to a node between the first switch and the driving transistor.

16. The organic light emitting display as claimed in claim 1, wherein when the previous scan line is maintained at a low level, the scan line is maintained at a high level, and the emission line changes to a high level, a threshold voltage of the driving transistor is reflected in the first and second capacitor, such that a voltage of the control electrode of the driving transistor has the voltage the level of the third power line, and the threshold voltage of the driving transistor is compensated.

17. The organic light emitting display as claimed in claim 16, wherein when the previous scan line changes to a high level, the scan line changes to a low level, and the emission line changes to a low level, a data voltage of the data line is stored in the first and second capacitors and simultaneously, a threshold voltage of the organic light emitting diode is reflected.

18. The organic light emitting display as claimed in claim 17, wherein when the previous scan line is maintained at a high level, the scan line changes to a high level and the emission line is maintained at a low level, current provided to the organic light emitting diode through the driving transistor increases due to the data voltage and the threshold voltage of the organic light emitting diode reflected in the first and second capacitor.

19. The organic light emitting display as claimed in claim 18, wherein the current provided to the organic light emitting diode increases in proportion to the threshold voltage of the organic light emitting diode.

* * * * *